US005372444A

United States Patent [19]

Lhuisset

[11] Patent Number: 5,372,444

[45] Date of Patent: Dec. 13, 1994

[54] APPLICATOR DEVICE WITH SIDE ACTUATED RACHET WHEEL

[75] Inventor: François N. B. Lhuisset, Montgeron, France

[73] Assignee: LVMH Recherche, France

[21] Appl. No.: 934,658

[22] PCT Filed: Jul. 9, 1991

[86] PCT No.: PCT/FR91/00555

§ 371 Date: Feb. 18, 1993

§ 102(e) Date: Feb. 18, 1993

[87] PCT Pub. No.: WO92/00689

PCT Pub. Date: Jan. 23, 1992

[30] Foreign Application Priority Data

Jul. 10, 1990 [FR] France ..... 90 08765

[51] Int. Cl.[5] ..... A46B 11/02

[52] U.S. Cl. ..... 401/175; 401/61; 401/66; 401/179; 401/181; 401/269; 401/288

[58] Field of Search ..... 401/175, 66, 172, 61, 401/269, 179, 181, 288

[56] References Cited

U.S. PATENT DOCUMENTS

| | | | |
|---|---|---|---|
| 2,505,438 | 4/1950 | Stoller | 401/66 X |
| 3,655,290 | 4/1972 | Griffith | 401/186 |
| 4,071,300 | 1/1978 | Nichols et al. | 401/175 |
| 5,033,652 | 7/1991 | Kay et al. | 401/61 X |

FOREIGN PATENT DOCUMENTS

| | | | |
|---|---|---|---|
| 95359 | 7/1923 | Australia | 401/166 |
| 0312165 | 4/1989 | European Pat. Off. . | |
| 684775 | 3/1930 | France | 401/175 |
| 762669 | 4/1934 | France . | |
| 1027484 | 5/1953 | France . | |
| 2483366 | 12/1981 | France . | |
| 2606675 | 5/1988 | France . | |
| 2622128 | 4/1989 | France . | |
| 228286 | 2/1925 | United Kingdom | 401/175 |

*Primary Examiner*—Steven A. Bratlie
*Attorney, Agent, or Firm*—Steinberg, Raskin & Davidson

[57] ABSTRACT

An applicator device for high or low viscosity liquids essentially comprises a container (R) having a plunger (2) which can be operated by turning a rod (3), whereby the liquid in the container is squeezed out into an applicator brush (4). Said rod (3) is hollow and carries the brush (4) at one of its ends (3*b*) while the other end (3*a*) is immersed in the container (R). Between these ends, it passes through the plunger (2) and is in engagement therewith via a screw thread (3*c*). Said rod (3) is rotated by a ratchet wheel (10) controlled by a side push-button (6). The applicator device allows a viscous product such as nail varnish to be delivered, for example to a brush.

12 Claims, 5 Drawing Sheets

3a
R
3c
2
2a
25
24
5
28
21
V
V
23
12
8a
8
10
6
13
26
3
7
31
27
13
31
1
20
15
31a
13b
32
30
29
3b
32
33
14
VI
4

APPLICATOR DEVICE WITH SIDE ACTUATED RACHET WHEEL

BACKGROUND OF THE INVENTION

The present invention has essentially as its subject an improved applicator device for more or less viscous liquid products such for example as nail varnish.

One already knows for example from the documents FR-A-2,606,675 and FR-A-2,622,128 liquid applicators essentially comprising a container with a piston actuatable by the rotation of a rod itself operated by a button at one of the ends of the apparatus so as to cause the expulsion of the liquid contained in the container towards an applicator element which generally assumes the shape of a small brush.

However, the capacity of the tank of such applicator devices remains relatively limited in view of the fact that the mechanism for operating the expulsion of the liquid occupies a great portion of the length of the apparatus. In other words, taking into account the fact that the apparatus should have a limited length to lend itself to a convenient manipulation, the piston operating mechanism should necessarily occupy a great part of this length to the detriment of the capacity of the container.

SUMMARY OF THE INVENTION

Therefore, to remedy in particular the inconvenience hereabove, the present invention proposes an applicator apparatus the mechanical concept of which is such that the mechanism for the control of the delivery of the liquid to the applicator brush is remarkably compact. The delivery mechanism a length reduced to a minimum and occupies only a small length of the body of the apparatus to which consequently may be connected a tank of a relatively large capacity and permits to deliver with reliability an even very viscous liquid to the applicator brush as for example a liquid the viscosity of which amounts to several tenths of thousands of centipoises.

For that purpose, the invention has as its subject an applicator device for viscous liquid products such as nail varnish for example and of the type comprising a container with a piston actuatable by the rotation of a rod to cause the expulsion of the liquid contained in the container towards an applicator element such as a brush for example. In the present invention, the rod is hollow, carries the applicator element at one of its ends and plunges with its other end into the container after passage through the piston with which it co-operates through the medium of a threading in order that the rotation without any axial displacement of the hollow rod causes the axial displacement without rotation of the piston in the container.

According to an embodiment of the present invention, the rotation of the aforesaid hollow rod is ensured by a ratchet wheel controlled by a lateral push-button.

One therefore already understands that the insertion of one portion of the piston operating rod into the container and the provision of a lateral push-button are substantially minimizing the length of the control mechanism and such an advantage may be turned to account to increase the capacity of the container.

According to another characteristic of this device, the lateral push-button comprises two substantially parallel arms slidably mounted through the body of the apparatus and extending along a direction orthogonal to the axis of the ratchet wheel to co-operate with the teeth of this wheel through meshing and escapement along substantially one diameter of the wheel.

According to an exemplifying embodiment, the ratchet wheel is coaxially made fast to the hollow rod which is mounted in freely slidable and rotating relationship in a part slidably but non-rotatably mounted in the body of the apparatus and capable of being actuated by a closure cap of the apparatus. One should further specify here that the end of the part opposite to that adapted to co-operate with the cap is provided with at least one stop for blocking the push-button and/or the ratchet wheel when the apparatus is shut off by the cap.

According to another embodiment, the ratchet wheel is axially made fast to a part mounted in freely slidable and rotating relationship in the body of the apparatus and capable of being actuated by a closure cap of the apparatus, which part rotates the aforesaid hollow rod which is mounted in freely slidable but non-rotating relationship within the part and which freely extends through the ratchet wheel.

According to another characteristic of this embodiment, the end of the hollow rod carrying the applicator element is provided with at least one snug, or other comparable element, displaceable in a groove formed in a sleeve formed in the part and receiving the hollow rod.

According to still another characteristic, the part comprises on its external periphery teeth, or other comparable element, capable of co-operating with teeth provided at the level of the end of the body of the apparatus to provide from the beginning of the mounting through screwing of the cap upon this part, a blocking in rotation of the part the translatory motion of which causes the disengagement of the ratchet wheel by moving of the latter away from the arms of the push-button.

According to still a further characteristic of the invention, the hollow rod is slidably mounted in a cross member constituting the upper portion of the container and is provided with a stop co-operating with this cross member and following which is extending a threading co-operating with a threaded opening of the piston.

The periphery of the piston co-operates in a fluid-tight manner and without any rotation with the side wall of the container upon its displacement in the container operated by the rotation of the hollow rod plunging into the container and inside of which passes the liquid having to reach the applicator brush.

According to still another embodiment according to this invention, the rotation of the hollow rod is ensured by the manual and relative rotation of the container with respect to a head into which is integrated the hollow rod which thus is made fast against rotation to the head.

One should further specify that in the head is accommodated the end of the hollow rod carrying the applicator element whereas the other end of the hollow rod extending into the tank is projecting from the head.

BRIEF DESCRIPTION OF THE DRAWINGS

Further characteristics and advantages invention will appear better in the detailed description which follows and refers to the annexed drawings given by way of example only and in which.

DETAILED DESCRIPTION OF THE INVENTION

Figure 1:
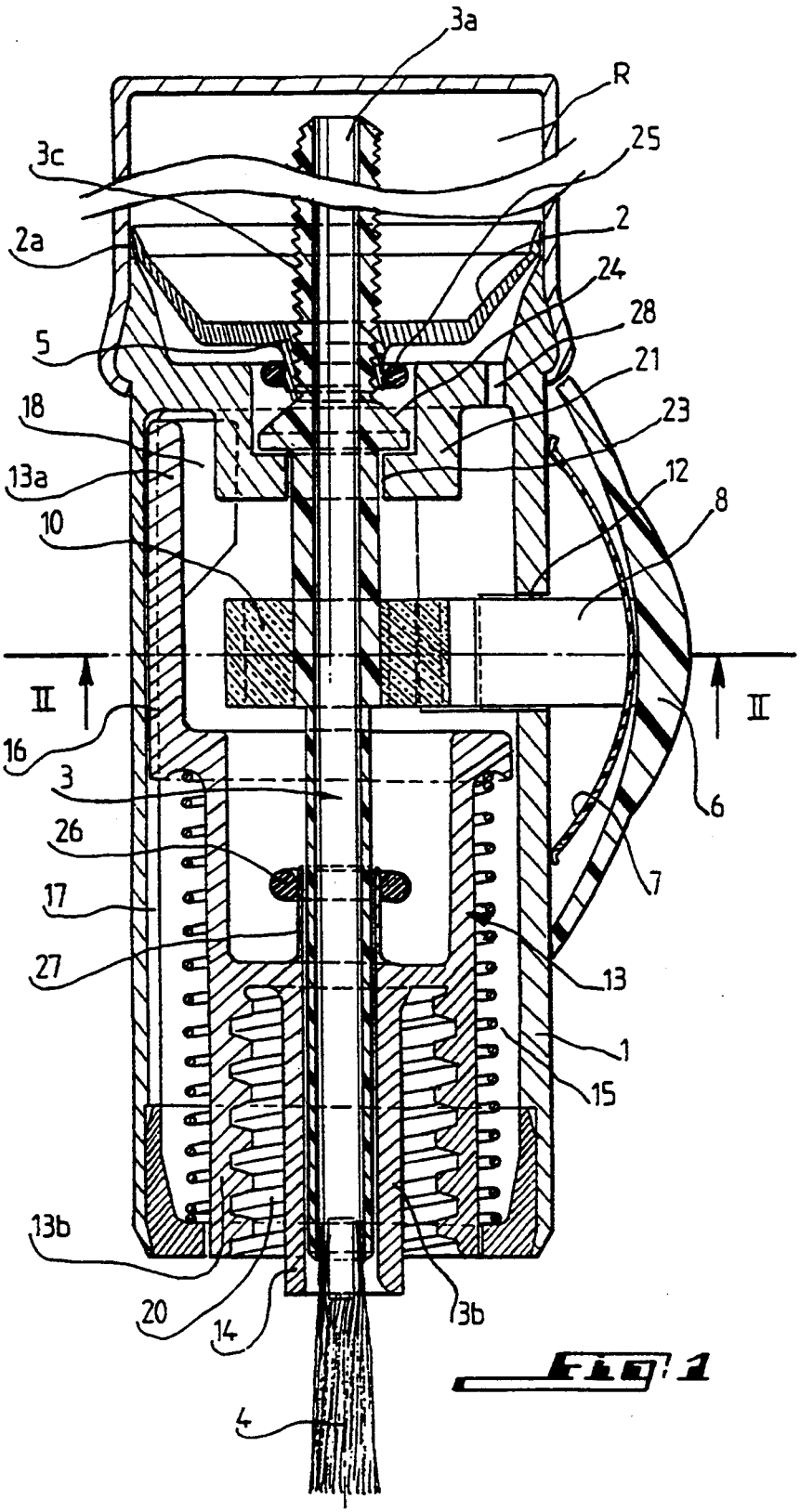
FIG. 1 is a diagrammatic and partial view in axial section of an applicator device according to the principles of the invention according to a first embodiment.
Figure 2:
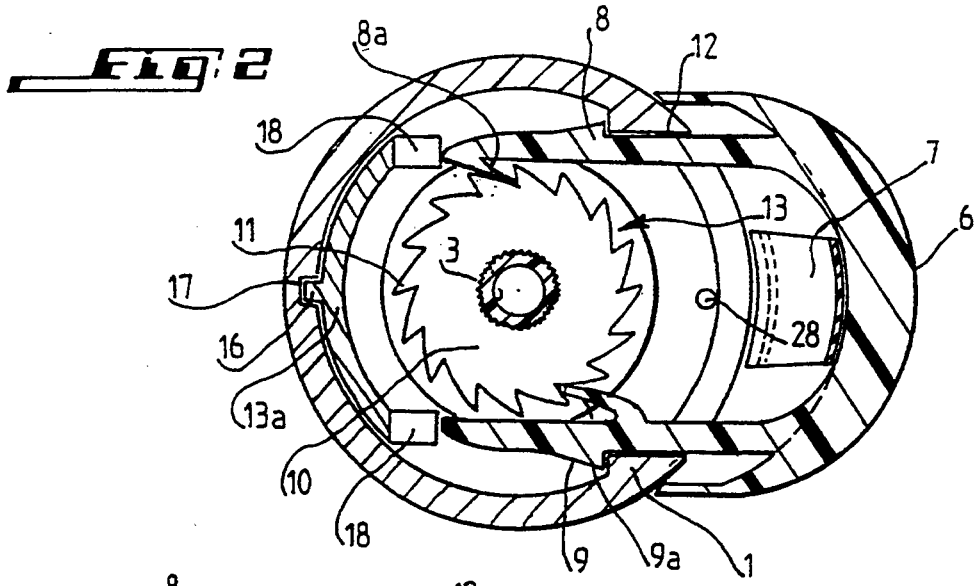
FIG. 2 is a view in section along the line II—II of FIG. 1.
Figure 3:
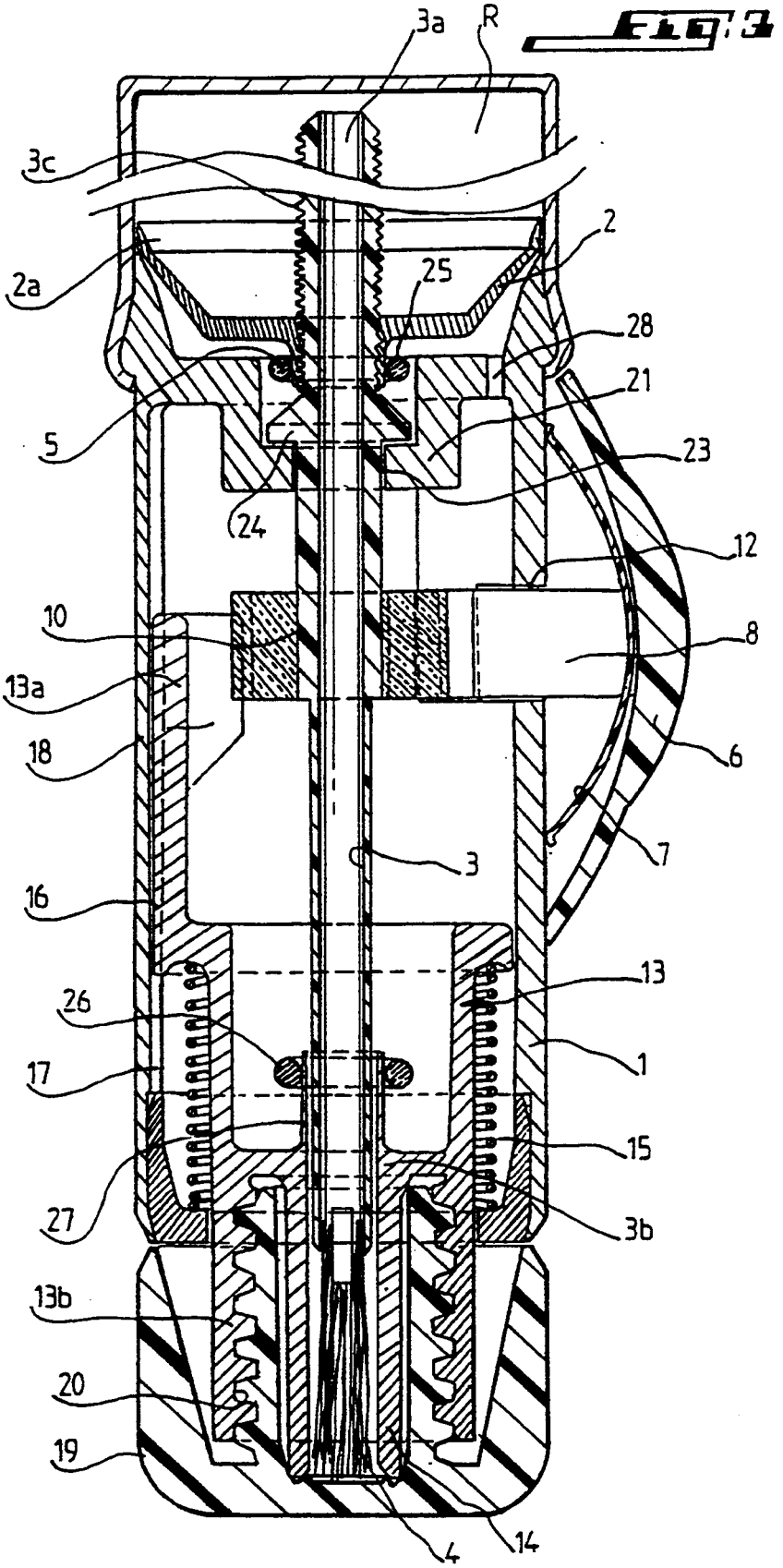
FIG. 3 is a view similar to that of FIG. 1 but showing the apparatus in the position closed by a cap.

Referring in particular to FIGS. 1 to 3 and according to an exemplifying embodiment, one sees that an applicator device according to this invention essentially comprises a body 1 forming the head of the apparatus and to which is connected a container R in which is sliding a piston 2 actuatable by a hollow rod 3 one end 3*a* of which extends into the container R and the other end 3*b* of which carries an applicator brush 4.

The end 3*a* of the hollow rod is provided with a threading 3*c* and extends through a threaded aperture 5 of the piston 2 so that the rotation of the rod operated by a push-button 6 provided on the side wall of the body 1 will permit the displacement of the piston 2 in the tank R and consequently the delivery of the liquid product contained in this container to the applicator brush 4 via the inside of the hollow rod 3.

As one sees it better in FIG. 2, the push-button 6 urged backwards according to the example shown by a spring plate 7 comprises to substantially parallel arms 8, 9 slidably mounted through the body 1 of the apparatus. These two arms 8, 9 extend in orthogonal relation to the axis of a ratchet wheel 10 seated on the hollow rod 3. The arms 8, 9 comprise each one at least one tooth 8*a*, 9*a* alternately co-operating through meshing and escapement with the teeth 11 of the ratchet wheel 10 as described later in connection with the operation of the invention. One has shown at 12 the sliding passage of the arms 8, 9 of the lateral push-button 6 into the body 1 of the apparatus.

The hollow rod 3 is mounted with its end 3*b* in freely axially sliding and freely rotating relationship in a part 13 which comprises a sleeve-shaped element 14 in which the hollow rod 3 may slide and turn. This part 13 constantly urged by a spring 15 into a position retracted into the body 1 of the apparatus is mounted in axially sliding but non rotating relationship in the body 1. One has shown at 16 in FIGS. 1 and 2 provided on the external periphery of the part 13 and co-operating with a groove, or other equivalent indentations, 17 provided on the internal periphery of the body 1 to prevent the part 13 from rotating within the said body while allowing it to slide therein. One should observe as one sees it well in FIGS. 1 and 2 that the rib 16 is provided on an extension 13*a* of the part 13, which extension exhibits in cross section somewhat the shape of a half-shell and carries stops 18 for blocking the arms 8, 9 of the push-button 6, this blocking taking place when the part 13 is extracted from the body 1 by the screwing of a cap 19 (FIG. 3) into a threading 20 provided on the internal periphery of an annular envelope 13*b* belonging to the part 13 and externally coaxial with the sleeve 14.

One has shown at 21 a wall or cross member constituting the end of the body 1 and forming in a way the upper part of the container R mounted on the body 1 at the level of the said cross member. This cross member 21 has a central aperture 23 in which may freely rotate the hollow rod 3 on which is provided a stop 24 bearing upon the cross member to permit the displacement of the piston 2 under the effect of the rotation of the hollow rod 3 operated by the lateral push-button 6 as described in detail later in connection with the operation of the invention.

An elastic ring 25 is provided at the level of the threaded aperture 5 of the piston 2 to provide or improve the fluid-tightness between the piston and the hollow rod on this level. The periphery 2*a* of the piston 2 forms in a way a lip co-operating in sealing relationship with the internal wall of the container R and this while preventing the piston from rotating during the rotation of the hollow rod 3 for operating the longitudinal displacement of the piston in the container R. In this respect to the piston 2 could exhibit like the container R a circular shape or also any polygonal shape of a nature capable of co-operating in sealing relationship and without any rotation with the side wall of the container. The risks of rotation of the piston 2 inside of the container R may further be avoided owing to a slight ovalization or a slight flattening of the inner section of the container, the piston of course having an identical and corresponding shape.

One has shown at 26 in FIGS. 1 and 3 another elastic ring for the clamping of a thin skirt 27 extending in a way the sleeve 14 on the hollow rod 3. This elastic ring 26 will permit to retain the fluid-tightness without preventing the rotation of the hollow rod 3 or the axial displacement of the part 13 with respect to this hollow rod upon the screwing of the cap 19 into the threading 20.

The previously mentioned cross member 21 comprises at least one vent-hole designated at 28 and permitting the passage of the air upon the displacement of the piston 2 under the effect of the rotation of the hollow rod 3, the stop 24 of which co-operates through bearing reaction with the cross member 21.

For a better understanding of the invention, one shall hereinafter describe the operation of the applicator device which has just been described with reference to FIGS. 1 to 3.

One should start from the "open" or ready-to-operate position of the apparatus as shown in FIG. 1.

In this position the user could with the finger exert a pressure upon the lateral push-button 6 so that as one understands it with the assistance of FIG. 2, the tooth 9*a* of the arm 9 will rotate the ratchet wheel 10 and hence the hollow rod 3 which will cause the displacement of the piston 2 in the container R and the delivery of the viscous product such as nail varnish contained in this container to the applicator brush 4 whereas the tooth 8*a* of the arm 8 having a reverse direction from that of the tooth 9*a* will escape from the teeth 11 of the ratchet wheel 10. The continuity of the displacement of the piston 2 in the container R will be ensured by the release of the push-button 6 since the tooth 8*a* of the arm 8 will mesh with and will continue to drive the ratchet wheel 10 while the tooth 9*a* of the arm 9 will escape from the said wheel.

Thus, by a simple pressure on and release of the lateral push-button 6 the applicator brush 4 could be impregnated with some amount of viscous product contained in the container R, it being understood that the push-button could be actuated at will in accordance with the needs.

At the end of utilization and as one sees it in FIG. 3, the user could screw the cap 19 onto the part 13 so that the applicator brush 4 will in a way be retracted into the sleeve 14. Thus, the brush will remain in permanent contact with the solvent vapors of the product contained in the container, which will avoid the drying and the hardening of the residual product between the bristles of the brush. One should observe here that the screwing of the cap 19 will be effected against the return force of the spring 15, it being understood that the part 13 may not rotate within the body 1 owing to the rib 16 co-operating with the grooves 17. At the end of the screwing of the cap 19 the stops 18 will be caused to block the arms 8, 9 of the push-button 6 the undue actuation of which will thus not risk to feed the applicator brush 4 with the product. One should note here that the stops 18 may assume any suitable shape whatsoever and which would for example be apt to block the ratchet wheel 10 itself against rotation.

The subsequent uses of the apparatus will quite simply be carried out by the unscrewing of the cap 19 which will cause the retraction of the part 13 into the body 1 and therefore the unlocking of the ratchet wheel.

Figure 5:
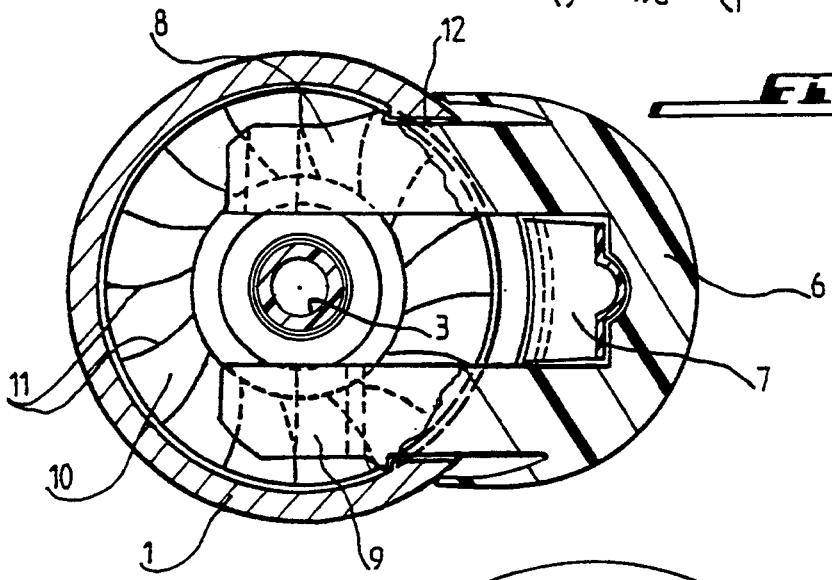
FIG. 5 is a view in section along the line V—V of FIG. 4.

A second embodiment of the applicator device according to this invention will now be described with reference to FIGS. 4 to 6 on which one has used the same reference numeral as those of FIGS. 1 to 3 to designate the common elements.

Here the ratchet wheel 10 is made fast to the part 13 which is mounted in freely sliding relationship in the body 1 of the apparatus but which contrary to the preceding embodiment is mounted also in freely rotating relationship within the body 1.

As to the hollow rod 3 it freely extends through the ratchet wheel 10 and it is mounted in freely sliding but non rotating relationship in the sleeve 14 of the part 13.

In effect, the end **3*b* of the hollow rod 3 is provided on its periphery with a snug 29 displaceable in a groove 30 formed inside of the sleeve 14 and parallel to the axis of the sleeve. Therefore, the rotation of the part 13 will cause the rotation of the hollow rod 3, it being understood that by screwing of the cap 19 onto the part 3, there will be an axial relative sliding between this part and the hollow rod 3**.

Figure 6:
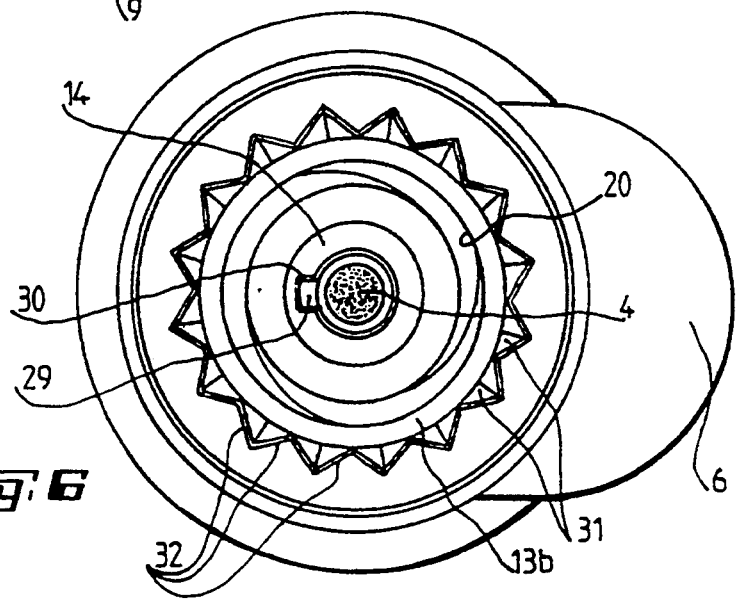
FIG. 6 is an end view of the apparatus of FIG. 4 according to the arrow VI of this figure.
Figure 4:
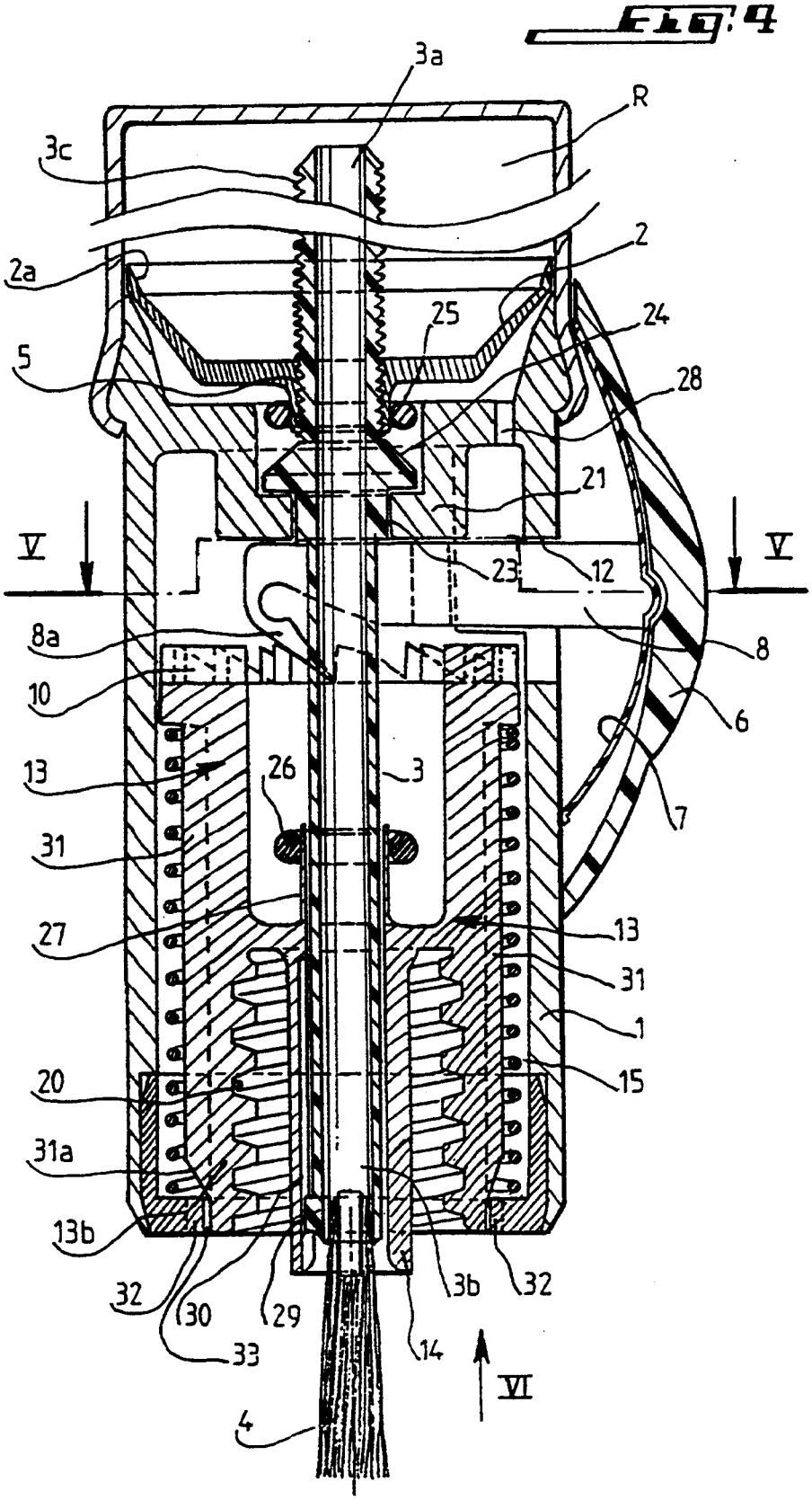
FIG. 4 is a partial diagrammatic view in axial section of a second embodiment of the applicator device according to this invention.

Furthermore, as one sees it well in FIGS. 4 and 6, the part comprises on its external periphery teeth, or other protrusions, 31 capable of co-operating with teeth 32 provided at the level of the opening end 33 of the body 1 of the apparatus through which the part 13 may move out under the effect of the screwing of the cap 19. As described later in connection with the operation, the co-operation of the teeth 31 and 32 takes place from the beginning of the screwing of the cap 19 into the part 13 so as to thus immobilize the part 13 against rotation to allow the screwing.

One finds again on this embodiment as in the foregoing embodiment the lateral push-button 6 with its two arms 8, 9.

For a better understanding of the invention, the operation of the applicator device will now be described.

One should start from the position visible in FIG. 4, i.e. from the "open" or ready-to-use position of the apparatus.

The user by pressure on and release of the push-button 6 will cause, owing to the arms 8,9 and exactly as previously described the driving of the ratchet wheel 10 and this through alternate meshing and escapement of the teeth **8*a*, 9*a* which these arms comprise and which extend along substantially one diameter of the ratchet wheel 10 as this was the case previously. One should observe here that the teeth 8*a* and 9*a*** are directed in the reverse direction with respect to each other.

The ratchet wheel 10 being made fast to the part 13, this part 13 will thus be rotated which will cause owing to the co-operation of the snug 29 with the groove 30, the operative rotation of the hollow rod 3 and therefore the displacement of the piston 2 in the container R so that some amount of viscous product will be carried via the hollow rod 3 to the applicator brush 4.

At the end of the use of the apparatus, i.e. when the user will screw the cap 19 (not shown in FIG. 4) into the threading 20 of the part 13, the teeth 31 of this part will come in engagement with the teeth of corresponding shape 32 of the body 1 of the apparatus which will cause an immobilization of the part 13 against rotation to permit the screwing of the cap. One should observe here as one sees it in FIG. 4 that the teeth 31 of the part 13 are chamfered at **31*a*, i.e., near the opening 33 of the body 1 to provide the immobilization of the part 13 as from the beginning of the screwing of the cap 19**.

But above all it is important to observe that the screwing of the cap 19 which controls the issuing of the part 13 from the body 1 of the apparatus, will permit the ratchet wheel 10 to escape from the arms 8, 9 of the push-button 6. Otherwise said at the end of the screwing of the plug 19, i.e. in the closed position of the apparatus, any undue action upon the push-button 6 will have no effect since the ratchet wheel 10 made fast to the part 13 will be disengaged.

In order to put the apparatus in service again it suffices to remove the cap 19 by unscrewing it, which will cause the retraction of the part 13 into the body 1 under the effect of the spring 15 and the ratchet wheel 10 made fast to the part 13 will again be in the disengaged position as one sees it in FIG. 4.

Figure 7:
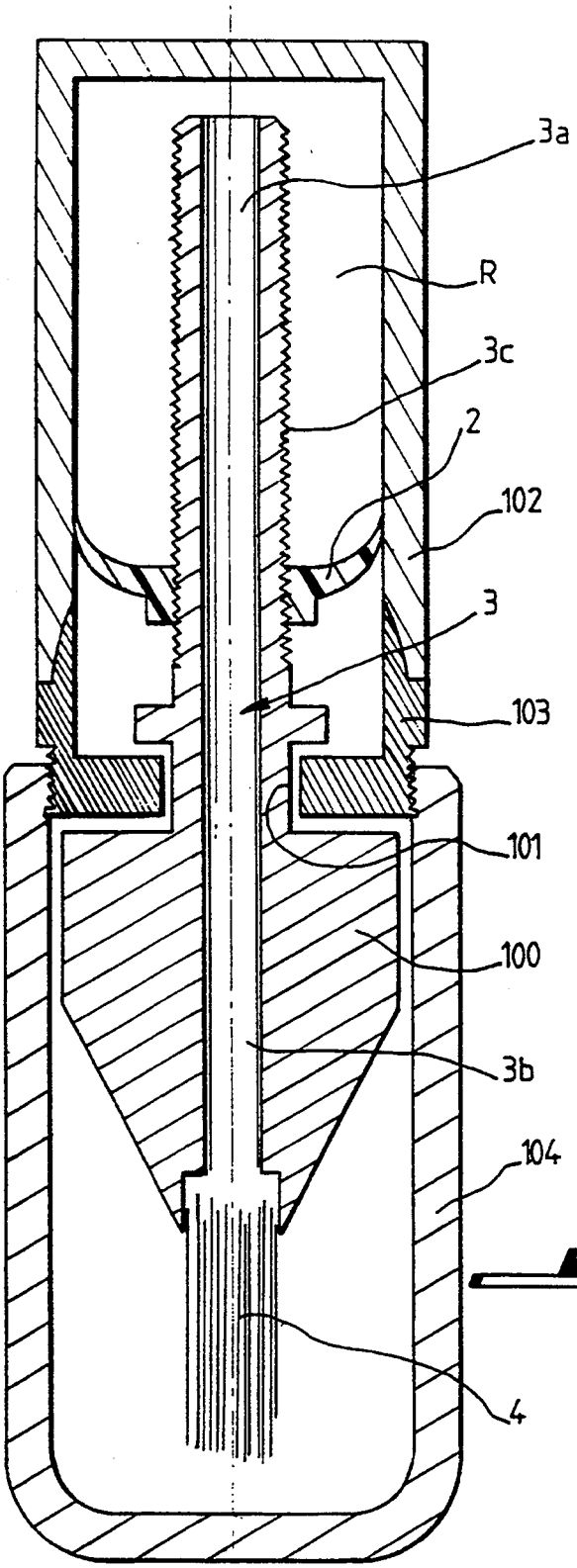
FIG. 7 is a very diagrammatic view in axial section of a third embodiment of the applicator device according to this invention.

One will now briefly describe a third embodiment of the applicator device according to this invention with reference to FIG. 7.

Here the hollow rod 3 is made fast against rotation to a head 100 so that the manual and relative rotation of the container R with respect to the head 100 ensures the translator motion without any rotation of the piston 2 so as to deliver the product to the applicator brush 4 carried by the head 100.

More precisely the applicator brush 4 is mounted at the end **3*b* of the hollow rod 3, which end 3*b* results from an axial bore formed in the head 100. As to the other end 3*a* of the hollow rod 3 extending into the container R, it projects from the head 100**.

At the connection of the head 100 with the end **3*a* of the hollow rod 3 is provided a shoulder 101 permitting the holding and the rotation of the head onto the container R which may be formed of two parts 102, 103** to permit its connection.

One has shown at 104 a cap capable of screwing itself or of being clipped itself upon the tank R.

One has thus provided according to the invention a particularly useful and reliable applicator device for the delivery of viscous products such as nail varnish, i.e. raising no problem of flow of the product and of delivery of this product to the applicator brush, this device only requiring a volume of minimum length for the housing of the mechanical and controlled portion of the apparatus.

The invention is of course not at all limited to the embodiments described and illustrated which have been given by way of example only.

Thus, the material of the different mechanical members of the apparatus may be any suitable material such as a synthetic material.

The invention therefore comprises all the technical equivalents of the means described as well as their combinations if the latter are carried out according to its gist.

I claim:

1. An applicator device for viscous liquids comprising:

a body, a liquid-containing container arranged in said body, a piston arranged in said container, said piston having a threaded aperture, a hollow rod having a first end, a second end opposite to said first end and a threading arranged on an outer surface, said second end extending into said container, said hollow rod passing through said piston, said threading of said hollow rod cooperating with said threaded aperture of said piston such that a rotation of said hollow rod causes an axial displacement of said piston in said container, a brush member arranged at said first end of said hollow rod, the rotation of said hollow rod causing expulsion of the liquid in said container toward said brush member, a ratchet-wheel arranged coaxial to said hollow rod and rotatively made fast to said hollow rod, said ratchet-wheel having teeth, and a lateral push-button for causing said ratchet-wheel to rotate, said push-button comprising two substantially parallel arms slidably mounted through an aperture in said body and extending in a direction orthogonal to an axis of said ratchet-wheel to co-operate with said teeth of said ratchet-wheel through alternate meshing and escapement of said two arms with said teeth, said two arms having teeth co-operating with said teeth of said ratchet-wheel.

2. A device according to claim 1, further comprising a part having a first end and an opposite second end, said part being arranged in said body to slide in an axial direction but not rotate, said hollow rod being arranged to freely rotate in said part, and a closure cap screwed onto said first end of said part, said cap being rotated to extract said part from said body and lock the operation of the device.

3. A device according to claim 2, wherein said second end of said part comprises at least one stop member for blocking said ratchet-wheel when the device is closed by said cap.

4. A device according to claim 1, wherein the liquid is nail varnish.

5. A device according to claim 1, further comprising a spring plate arranged between said push-button and said body, said push-button being moved in a first direction such that said two arms contact and rotate said ratchet-wheel, said spring plate urging said push-button in a second direction opposite to said first direction.

6. A device according to claim 1, further comprising a part arranged in said body to slide in an axial direction but not rotate, said hollow rod being arranged to freely rotate in said part, said part comprising a sleeve in which said hollow rod is received, and a spring urging said part into said body such that said sleeve is moved into said body to expose said brush member.

7. A device according to claim 6, further comprising means to prevent rotation of said part within said body.

8. A device according to claim 6, wherein said means comprise a rib arranged on an external periphery of said part, and a groove arranged on an inner surface of said body such that said rib is received within said groove.

9. An applicator device for viscous liquids comprising:

a body, a liquid-containing container arranged in said body, a piston arranged in said container, said piston having a threaded aperture, a hollow rod having a first end, a second end opposite to said first end and a threading arranged on an outer surface, said second end extending into said container, said hollow rod passing through said piston, said threading of said hollow rod cooperating with said threaded aperture of said piston such that a rotation of said hollow rod causes an axial displacement of said piston in said container, a brush member arranged at said first end of said hollow rod, the rotation of said hollow rod causing expulsion of the liquid in said container toward said brush member, a part arranged in said body to freely slide and rotate, a ratchet-wheel axially made fast with said part, said ratchet-wheel having teeth, and a lateral push-button for causing said ratchet-wheel to rotate, said push-button comprising two substantially parallel arms slidably mounted through said body and extending in a direction orthogonal to an axis of said ratchet-wheel to co-operate with said teeth of said ratchet-wheel through alternate meshing and escapement of said two arms with said teeth, and said hollow rod extending through said ratchet-wheel and being mounted in a non-rotating relationship in said part, such that rotation of said part causes rotation of said hollow rod and displacement of said piston to carry liquid via said hollow rod to said brush member.

10. An applicator device according to claim 9, wherein said part comprises a sleeve having a groove formed therein, said hollow rod being received within said sleeve, said first end of said hollow rod having at least one snug displaceable in said groove.

11. An applicator device according to claim 9, wherein said part comprises teeth arranged on an external periphery, said teeth co-operating with additional teeth arranged at an end of said body, said device further comprising a closure cap screwable onto said part such that by screwing said cap onto said part, rotation of said part is prevented and said two arms are disengaged from said ratchet-wheel.

12. A device according to claim 9, wherein the liquid is nail varnish.

* * * * *